US006378541B1

(12) United States Patent
Matthews

(10) Patent No.: US 6,378,541 B1
(45) Date of Patent: Apr. 30, 2002

(54) ERGONOMIC CRUTCH

(76) Inventor: Donald H. Matthews, 20 Quaker Bottom Rd., Sparks, MD (US) 21152

( * ) Notice: Subject to any disclaimer, the term of this patent is extended or adjusted under 35 U.S.C. 154(b) by 0 days.

(21) Appl. No.: 09/699,644

(22) Filed: Oct. 30, 2000

(51) Int. Cl.[7] ..... A61H 3/02

(52) U.S. Cl. ..... 135/68; 135/71; 135/72; 135/73

(58) Field of Search ..... 135/66, 68, 69, 135/71–73, 75, 76

(56) References Cited

U.S. PATENT DOCUMENTS

| | | | | |
|---|---|---|---|---|
| 1,183,008 A | | 5/1916 | Hipwood | |
| 1,288,929 A | | 12/1918 | Kornstein | |
| 1,495,865 A | | 5/1924 | Moore | |
| 2,429,409 A | | 10/1947 | Eidman | |
| 2,568,654 A | | 9/1951 | Neptune | |
| 2,707,478 A | | 5/1955 | Davies | |
| RE24,874 E | | 9/1960 | Vander Molen | |
| 3,157,187 A | | 11/1964 | Murcott | |
| 4,763,680 A | | 8/1988 | Acosta, Sr. | |
| 4,787,405 A | * | 11/1988 | Karwoski | 135/66 |
| 5,193,567 A | * | 3/1993 | Razny | 135/68 |
| 5,318,058 A | * | 6/1994 | Zimmerman | 135/68 |
| 5,875,805 A | * | 3/1999 | Nichols | 135/66 |

* cited by examiner

*Primary Examiner*—Beth A. Stephan
(74) *Attorney, Agent, or Firm*—Leonard Bloom; Robert M. Gamson

(57) ABSTRACT

A crutch adapted to be used by a person has a vertical post with a loop formed in the center portion. An underarm support member is connected to the top of the post. The upper portion of the post above the loop is offset from the lower portion below the loop. The person's hand is supported on a selected portion of the loop. The underarm support has a pivoted sleeve thereon for the comfort of the person.

19 Claims, 4 Drawing Sheets

ERGONOMIC CRUTCH

BACKGROUND OF THE INVENTION

1. Field of the Invention

The invention is directed to a crutch adapted to be used by a person and more particularly to an ergonomic crutch which provides the user with multiple choices for placement of the user's hand in a hand support without any mechanical adjustment of the crutch.

2. Description of Related Art

A crutch is defined as a device often used in pairs, by lame people as an aid in walking. Typically the crutch has a staff with a hand grip and a cross piece which fits under the armpit. The conventional crutch has a forked vertical member with a transverse hand grip between the forked arms. Using the crutch is frequently uncomfortable and various designs have been made to improve the comfort and ease of use of the crutch.

U.S. Pat. No. 2,568,654 to Neptune is directed to a hand support on a vertical post which may be adjusted longitudinally while being rotated around the post. This patent recognizes that disposition of the user's hand is important for the comfort of the user.

Vander Molen, U.S. Pat. No. Re. 24,874 also recognizes the importance of the location of the handle and provides vertical adjustment as well as radial positioning of the handle around the rod.

Murcott, U.S. Pat. No. 3,157,187 addresses the relationship of the underarm support to the body and the hand grip member on a vertical post.

U.S. Pat. No. 4,763,680 to Acosta, Sr. discloses a crutch with an S-shaped curve defined in the upper portion.

The following U.S. patents are directed to improving the comfort of the underarm support by incorporating a means for the underarm support to pivot with the swinging of the crutch as the user walks:

| U.S. Pat. No. | Inventor(s) |
|---|---|
| 1,183,08 | Hipwood |
| 1,288,929 | Kornstein |
| 1,495,865 | Moore |
| 2,429,409 | Eidman |
| 2,707,478 | Davies |

These references and others recognize that the hand support member and the underarm member are portions of the crutch which must be designed for improved comfort for the user. However, the references address these members by providing for movement of the members to adapt to the anatomy of the user.

The present invention improves the comfort of the user, not by moving the hand support member, but by providing a hand support on which the user may select a position for greatest comfort.

BRIEF SUMMARY OF THE INVENTION

It is an object of the present invention to provide a crutch which permits a multiple of choices for placement of the hand without requiring any mechanical adjustment of the crutch.

It is a further object of the present invention to provide a crutch which permits the user to alternate his/her hand position on the hand support member to rest tired muscles and to relieve pressure points. The crutch of the present invention allows unobstructed access to any position on the hand support without twisting or stretching of the user's hand.

It is another object of the present invention to provide a crutch which creates a vertical alignment of the user's hand wrist, elbow, upper arm and shoulder.

In accordance with the teachings of the present invention, there is disclosed a crutch adapted for use by a person. The crutch has a vertical post having an upper portion, a lower portion and a center portion. The upper portion of the post has an underarm support member connected substantially perpendicularly thereto. The center portion of the post is formed in a loop substantially parallel to the underarm support defining a hand support. The lower portion of the post is vertically offset from the loop. In this manner, a hand of the person is supported on a selected portion of the hand support for improved comfort avoiding pressure on the hand between the thumb and the forefinger.

In further accordance with the teachings of the present invention, there is disclosed a crutch adapted to be used by a person. The crutch has a vertical post having an upper portion, a lower portion and a center portion. The center portion of the post has a hand support formed thereon. An underarm support member is connected to the upper portion of the post. A sleeve is received over the underarm support member. A pivoting means is formed at approximately a midpoint of the sleeve wherein the sleeve may pivotally move over the underarm support member to provide increased comfort for the person.

These and other objects of the present invention will become apparent from a reading of the following specification taken in conjunction with the enclosed drawings.

DESCRIPTION OF THE PREFERRED EMBODIMENT

Figure 1:
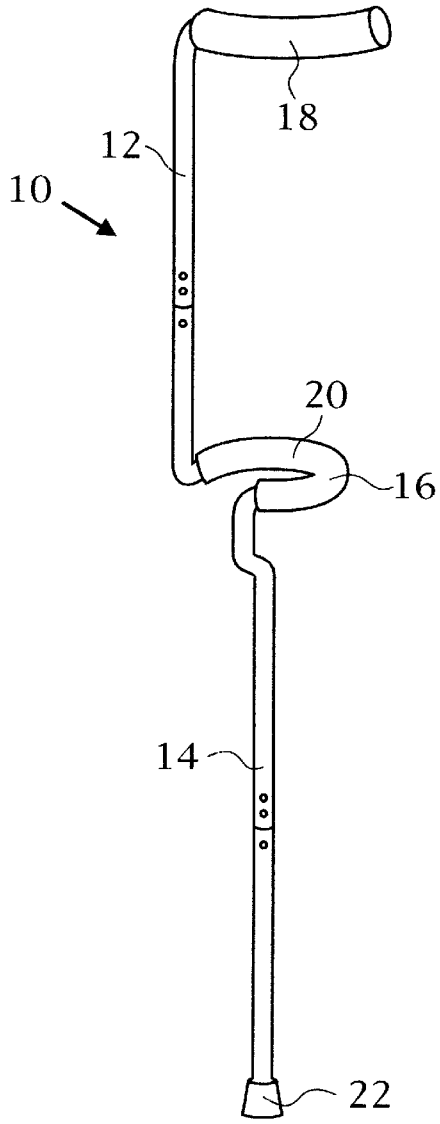
FIG. 1 is a perspective view of a lefthand crutch of the present invention.
Figure 2:
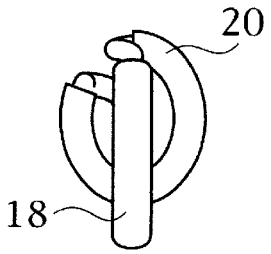
FIG. 2 is a top plan view of the crutch of FIG. 1.
Figure 3:
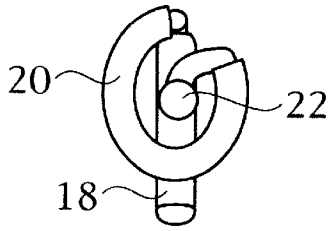
FIG. 3 is a bottom plan view of the crutch of FIG. 1.
Figure 4:
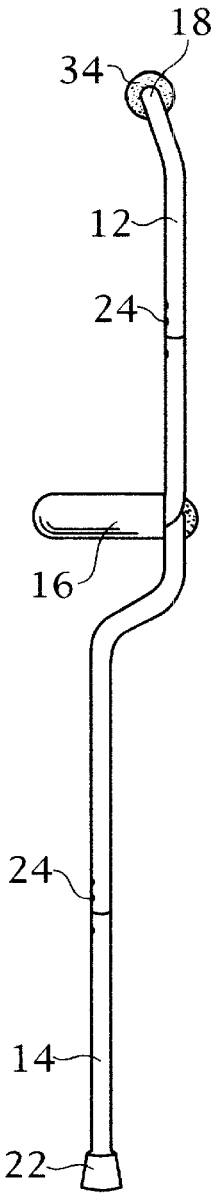
FIG. 4 is a front elevation view of the crutch of FIG. 1.
Figure 5:
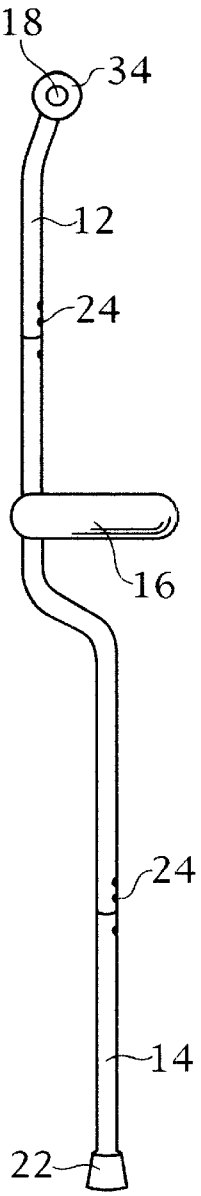
FIG. 5 is a front elevation view of an alternate embodiment of the crutch of FIG. 1.
Figure 6:
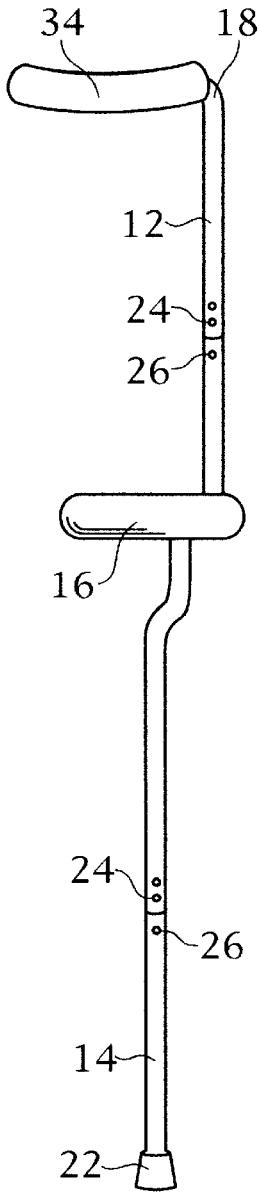
FIG. 6 is a right side elevation view of the crutch of FIG. 1.
Figure 7:
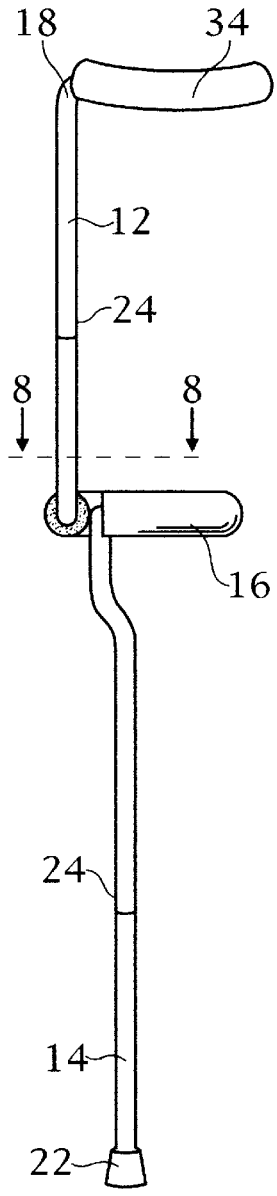
FIG. 7 is a left side elevation view of the crutch of FIG. 1
Figure 8:
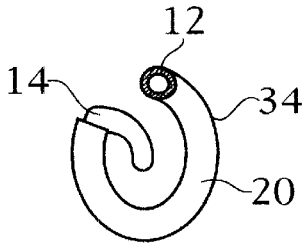
FIG. 8 is a cross-section view taken across the lines 8—8 of FIG. 7.

Referring now to FIGS. 1–7, the drawings show one of the members 10 of pair of crutches adapted to be used by a person. Each member (crutch) has a vertical post which has an upper portion 12, a lower portion 14 and a center portion 16. An underarm support member 18 is connected substantially perpendicularly to the end of the upper portion 12 of the post. The center portion 16 is formed in a loop 20 which is substantially parallel to the underarm support member 18. A hand support is defined by the loop 20. The term loop is used herein to describe the hand support of the crutch 10. It may be a closed loop or a partially opened loop. The loop may be circular, ovaloid, or angular but must have an open area within the loop wherein a portion of the person's hand is received in the open area when the person's hand is supported on the loop. The loop 20 has a length which extends outwardly in a horizontal plane with respect to the vertical post. The loop 20 has an inner segment disposed proximal to the person using the crutch 10 and an outer segment disposed distal from the person using the crutch. The loop 20 is formed on an integral part of the post and is not an addendum to the post. The loop 20 is not separable from the post.

The lower portion 14 of the post preferably has a non-slip foot 22 mounted thereon to contact the horizontal surface on which the crutch will be used.

The lower portion 14 of the post is offset from the loop 20. The lower portion 14 of the post is bent downwardly from the loop 20 and extends downwardly in a vertical plane approximately at the midpoint on the length of the loop 20 as shown in FIGS. 1 and 3–7. This configuration provides space for the user's hand to be supported on the loop 20 without interference by the lower portion 14 of the post.

The upper portion 12 of the post extends upwardly from the loop 20. In a first embodiment (FIG. 4) the upper portion 12 of the post which is proximal to the loop 20, is approximately perpendicular to the loop 20. The upper portion 12 of the post distal from the loop 20 is angled toward the person so that the underarm support 18 is comfortably disposed closer to the person in the armpit of the person. In a second embodiment (FIG. 5) the upper portion 12 of the post is angled from the loop 20 so that the underarm support 18 is comfortably disposed in the armpit of the person. The disposition of the underarm support 18 with respect to the loop 20 is the same in either embodiment.

When viewed from the front of the crutch 10 (FIGS. 4 and 5), the upper portion 12 is offset from the lower portion 14 in side-to-side relationship as compared to the loop 20. When viewed form the side of the crutch (FIGS. 6 and 7) the upper portion 12 is offset from the lower portion 14 is a front-to-back relationship as compared to the loop 20. These offsets provide for improved balance by the person using the crutch while maintaining structural integrity of the crutch 10.

In order to provide an adjustable height for use of the crutch 10 by persons of varying heights, the upper portion 12, the lower portion 14 or both the upper and lower portions are formed respectively of two telescoping sections 24 with stop means 26 such as a plurality of detents and openings. In this manner, the crutch may be adjusted for the comfort of persons with longer or shorter torsos and/or with longer or shorter legs.

Figure 9:
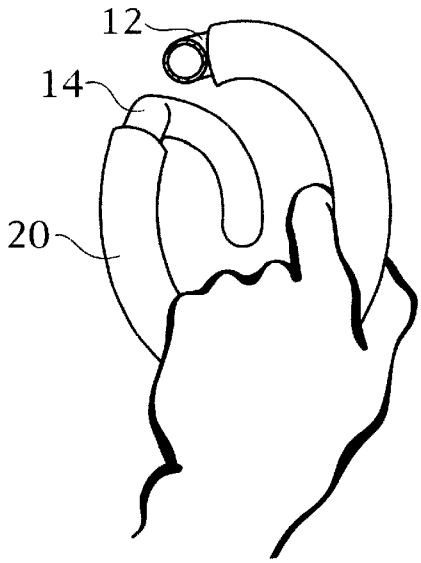
FIG. 9 is an enlarged top view showing the person's left hand supported on the loop.
Figure 10:
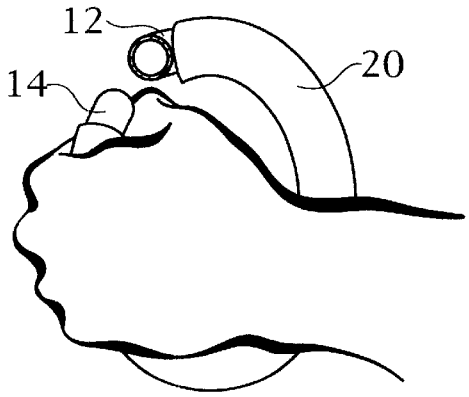
FIG. 10 is an enlarged top view showing the person's left hand supported on another portion of the loop.
Figure 11:
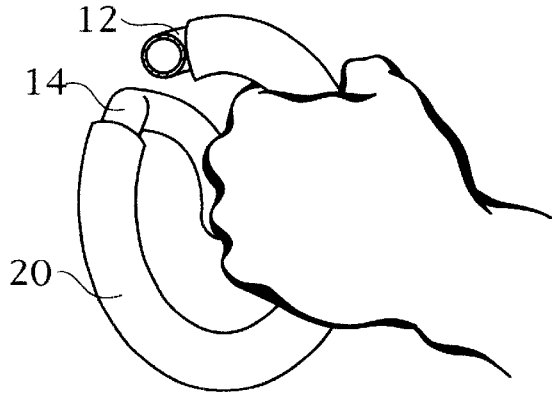
FIG. 11 is an enlarged top view showing the person's left hand supported on still another portion of the loop.
Figure 12:
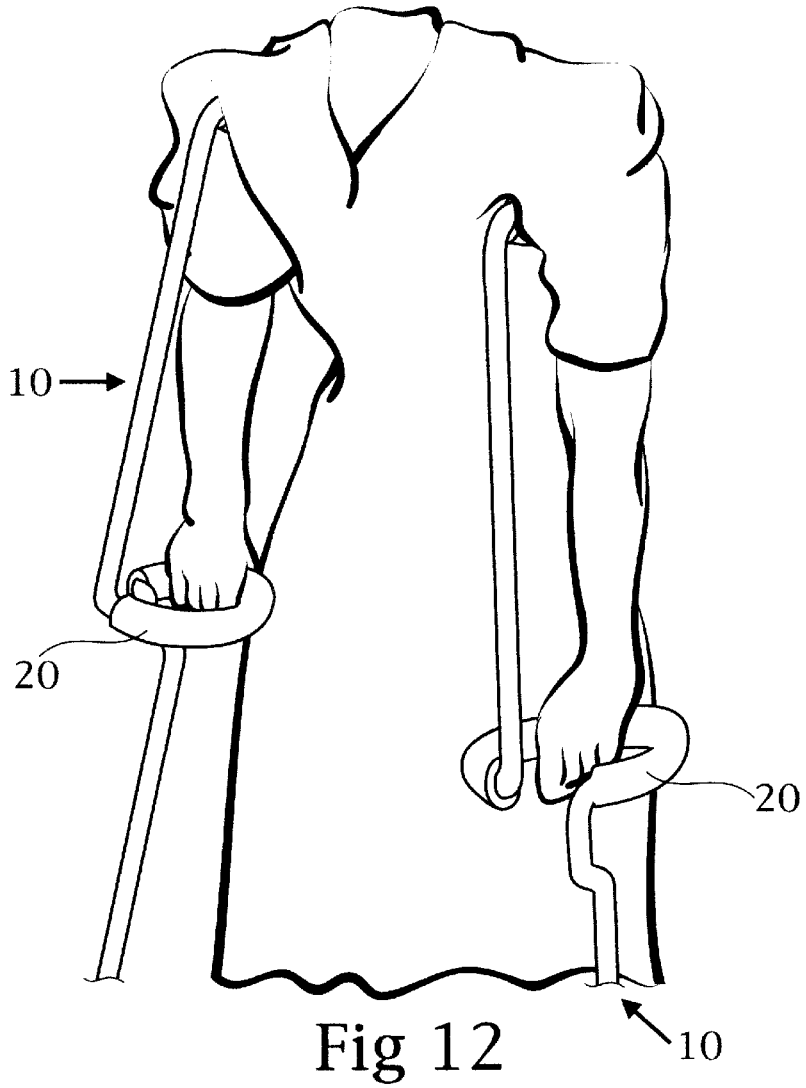
FIG. 12 is a perspective view of person using two crutches of the present invention with the hand supported on the loop such that the hand, wrist, elbow, upper arm and shoulder are in a vertical alignment.

Referring to FIGS. 9–12, the present invention provides the person with options to select the portion of the loop which is most comfortable to support the hand. Also, the person may vary his/her hand to any other selected position if the person's hand becomes tired. It is believed that the greatest comfort can be provided when the person's hand is supported rearwardly on the loop 20 with the fingers within the loop 20 and the thumb proximal to the person's body outside the loop (FIG. 9). When the crutch 10 is used in this manner, there is a vertical alignment of the person's hand, wrist, elbow, upper arm and shoulder. None of the body parts are misaligned so as to place stress on one of the body parts. Rather all forces are in direct alignment. The hand being supported on the loop is approximately at a right angle to the person's hip and the person's weight is distributed over the entire open hand; particularly over the heel and palm of the hand. Little weight is borne by the sensitive area between the thumb and forefinger of the person. This is in contrast to the conventional crutch which has a hand support parallel to the hips and held between the thumb and forefingers. However, if desired, the person may support his/her hand on other portions of the loop of the present invention. FIG. 10 shows the person's hand supported on the portion of the loop 20 distal from the person's body. FIG. 11 shows the person's hand supported on the loop on the portion of the loop 20 proximal to the person's body. FIG. 12 shows a person using two crutches with their hands supported on the loop 20 as shown in FIG. 9.

It should be noted that there are no parts of the crutch 10 which must be moved, rotated or adjusted in any manner to provide alternate support locations for the person's hand. The loop 20 provides all the alternate support positions which the person may select as desired. Unobstructed access to any selection position of the loop 20 is provided without twisting, reaching or stretching by the person.

It is preferred that the crutch 10 be formed from metal tubing having a diameter of approximately ¾ inch. This size tube has sufficient strength to support an average person while having a weight which is not cumbersome.

Figure 13:
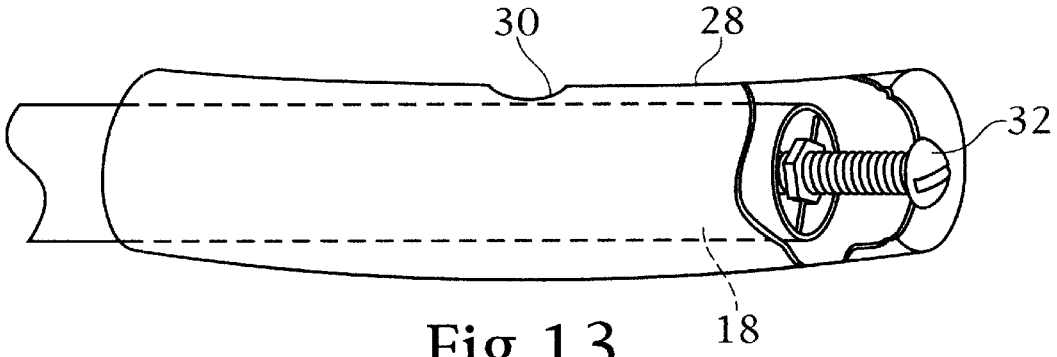
FIG. 13 is a cutaway side view of the underarm support showing a sleeve with a pivoting means received over the underarm support.

It is further preferred that a sleeve 28 be received over the underarm support member 18 (FIG. 13). A pivoting means 30 is formed approximately at a midpoint of the sleeve 28. The pivoting means 30 may be a dimple formed in the sleeve 28, a protrusion formed on the underarm support member 18 or other means known to persons skilled in the art. The sleeve 28 rocks and pivots as the person uses the crutch 10 alternately supporting the body on the underarm support member 18. This reduces strain and increases the comfort to the person. An adjustment means 32 is provided to move the sleeve 28 horizontally with respect to the underarm support member 18 so that the crutch 10 may be further adjusted for the comfort of the person. The adjustment means 32 may be a screw which spaces the end of the underarm support member 18 from the sleeve 28. Other adjustment means 32 known to persons skilled in the art may be used. When properly adjusted, the underarm support member 18 most comfortably conforms to the armpit of the person when the person is walking using the crutch 10.

In order to increase the comfort of use by the person, it is preferred that cushion 34 such as a foam plastic be disposed over the loop 20 and the underarm support member 18. The cushion 34 over the underarm support member 18 preferably is banana-shaped to be more easily accommodated by the armpit of the person.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A crutch adapted for use by a person comprising:

a vertical post having an upper portion, a lower portion and a center portion, the upper portion of the post having an underarm support member connected substantially perpendicularly thereto, the center portion of the post being formed in a loop substantially parallel to the underarm support defining a hand support, the lower portion of the post being vertically offset from the loop, wherein a hand of the person is supported on a selected portion of the hand support for improved comfort avoiding pressure on the hand between the thumb and the forefinger.

2. The crutch of claim 1, wherein the loop has a length extending outwardly from the upper portion of the post, the lower portion of the post extending downwardly in a vertical plane approximately at a midpoint on the length of the loop.

3. The crutch of claim 1, wherein the loop has an inner segment disposed proximal to the person and an outer segment disposed distal from the person, the lower portion of the post extending downwardly under the inner segment of the loop.

4. The crutch of claim 1, wherein the vertical post has an adjustable length for comfort of the person using the crutch.

5. The crutch of claim 4, wherein the upper portion of the post is formed of two telescoping sections and a stop means to adjust the length.

6. The crutch of claim 4, wherein the lower portion of the post is formed of two telescoping sections and a stop means to adjust the length.

7. The crutch of claim 1, further comprising a sleeve received over the underarm support members, a pivoting means formed at approximately a midpoint of the sleeve, wherein the sleeve may pivotally move over the underarm support member to provide increased comfort for the person.

8. The crutch of claim 7, further comprising an adjustment means for moving the sleeve horizontally with respect to the underarm support member such that the crutch may be adjusted to provide increased comfort for the person.

9. The crutch of claim 1, further comprising a cushioned covering disposed respectively over the underarm support member and the loop.

10. The crutch of claim 1, wherein the upper portion of the post proximal to the loop is approximately perpendicular to the loop and the upper portion of the post distal from the loop and on which the underarm support is connected, is angled toward the person.

11. The crutch of claim 1, wherein the upper portion of the post is angled so that the underarm support is disposed close to the person.

12. The crutch of claim 1, wherein the loop is disposed in a horizontal plane with respect to the vertical post.

13. A crutch adapted to be used by person comprising:

a vertical post having an upper portion, a lower portion and a center portion, the center portion of the post having a hand support formed thereon, an underarm support member being connected to the upper portion of the post, a sleeve received over the underarm support member, a pivoting means formed at approximately a midpoint of the sleeve, wherein the sleeve may pivotally move over the underarm support member to provide increased comfort for the person.

14. The crutch of claim 13, wherein the hand support is a loop substantially parallel to the underarm support member such that a hand of the person is supported on a selected portion of the loop for improved comfort.

15. The crutch of claim 13, wherein the vertical post has an adjustable length.

16. The crutch of claim 13, further comprising an adjustment means for moving the sleeve horizontally with respect to the underarm support member such that the crutch may be adjusted to provide increased comfort for the person.

17. The crutch of claim 13, wherein the lower portion of the vertical post is offset from the upper portion of the vertical post.

18. The crutch of claim 17, wherein the offset is in a front-to-back relationship between the lower portion and the upper portion.

19. The crutch of claim 17, wherein the offset is in a side-to-side relationship between the lower portion and the upper portion.

* * * * *